US008833454B2

(12) United States Patent
Duong

(10) Patent No.: US 8,833,454 B2
(45) Date of Patent: Sep. 16, 2014

(54) HYDROCARBON RECOVERY METHOD

(75) Inventor: Anh Ngoc Duong, Calgary (CA)

(73) Assignee: ConocoPhillips Company, Houston, TX (US)

( * ) Notice: Subject to any disclaimer, the term of this patent is extended or adjusted under 35 U.S.C. 154(b) by 173 days.

(21) Appl. No.: 12/839,118

(22) Filed: Jul. 19, 2010

(65) Prior Publication Data

US 2011/0017455 A1 Jan. 27, 2011

Related U.S. Application Data

(60) Provisional application No. 61/227,556, filed on Jul. 22, 2009.

(51) Int. Cl.
*E21B 43/24* (2006.01)
*E21B 43/30* (2006.01)

(52) U.S. Cl.
CPC ..... *E21B 43/2406* (2013.01); *E21B 43/305* (2013.01)
USPC ..... 166/303; 166/57; 166/272.3; 166/272.7

(58) Field of Classification Search
USPC ..... 166/268, 245, 272.1, 272.3, 272.6, 166/272.7, 303, 57
See application file for complete search history.

(56) References Cited

U.S. PATENT DOCUMENTS 2,974,937 A * 3/1961 Kiel ..... 299/2
4,085,803 A 4/1978 Butler
4,344,485 A 8/1982 Butler
4,390,067 A * 6/1983 Willman ..... 166/245
4,574,884 A 3/1986 Schmidt
4,577,691 A * 3/1986 Huang et al. ..... 166/272.3
4,598,770 A 7/1986 Shu et al.
4,700,779 A 10/1987 Huang et al.
4,706,751 A * 11/1987 Gondouin ..... 166/401
4,850,429 A 7/1989 Mims et al.
5,016,709 A * 5/1991 Combe et al. ..... 166/245
5,101,898 A 4/1992 Hong
5,244,041 A 9/1993 Renard et al.
5,246,071 A 9/1993 Chu
5,273,111 A 12/1993 Brannan et al.
5,803,171 A 9/1998 McCaffery et al.
6,257,334 B1 7/2001 Cyr et al.
6,536,523 B1 * 3/2003 Kresnyak et al. ..... 166/266
6,984,292 B2 1/2006 Kresnyak et al.
6,988,549 B1 * 1/2006 Babcock ..... 166/267
7,147,057 B2 12/2006 Steele et al.
7,516,789 B2 * 4/2009 Chhina et al. ..... 166/260
7,562,706 B2 * 7/2009 Li et al. ..... 166/245
7,717,175 B2 * 5/2010 Chung et al. ..... 166/268
2007/0199712 A1 8/2007 Hocking (Continued)

FOREIGN PATENT DOCUMENTS

WO 2009025693 2/2009

*Primary Examiner* — Kenneth L Thompson
(74) *Attorney, Agent, or Firm* — ConocoPhillips Company

(57) ABSTRACT

A process for increasing the efficiency of hydrocarbon recovery from an underground formation containing viscous hydrocarbons through the use of both gravity drainage and mobile water drive. The process comprises a pair of vertically-spaced horizontal wells and a laterally offset horizontal well. A heated fluid is injected into the formation via a first well pair, and an adjacent horizontal well creates a pressure sink to draw the heated fluid laterally to assist growth of the formation drainage area for hydrocarbon recovery improvement. Injected fluids recovered from both producers are collected for recycling.

17 Claims, 3 Drawing Sheets

(56) References Cited

U.S. PATENT DOCUMENTS

2007/0295499 A1 12/2007 Arthur et al.
2007/0295640 A1 12/2007 Tan et al.
2008/0110630 A1 5/2008 Minnich et al.
2008/0135254 A1 6/2008 Vinegar et al.
2009/0255661 A1* 10/2009 Clark et al. ..... 166/50

* cited by examiner

HYDROCARBON RECOVERY METHOD

STATEMENT REGARDING FEDERALLY-SPONSORED RESEARCH OR DEVELOPMENT

None.

FIELD OF THE DISCLOSURE

The invention generally relates to improved processes for the recovery of viscous hydrocarbons from underground formations, and drive mechanism recovery processes that increase the efficiency and decrease the cost associated with recovering viscous hydrocarbons from a subterranean formation.

BACKGROUND OF THE DISCLOSURE

For some time, processes have been employed to heat underground formations containing viscous hydrocarbon deposits, thereby lowering the viscosity of the petroleum contained within and providing a driving force to assist in the recovery of these viscous hydrocarbons. The use of horizontal drilling technology for viscous hydrocarbon recovery is well-established. An large area of contact between the wellbore and the formation can be achieved by drilling wells with a substantially horizontal component (typically, 300 to 2,000 meters). This large contact area allows the formation to be heated more efficiently by injection of a heated fluid, thereby reducing the injection pressure required to heat the formation to the minimum temperature required for viscous hydrocarbon recovery. Heating the viscous hydrocarbons within a formation reduces their viscosity, and gravity assists the downward flow of these hydrocarbons within the formation. This recovery mechanism has been known as SAGD (Steam Assisted Gravity Drainage) process and has been employed in recovering viscous hydrocarbons from oil sands over the last 20 years. Since gravity is only drive force behind the SAGD process, hydrocarbon recovery is relatively slow due to slow lateral growth of the heat chamber. To enhance the process, a new drive mechanism for improved lateral expansion of the heat chamber is needed.

In certain geographic areas, the cost associated with gravity-assisted hydrocarbon recovery is increased due to a lack of water for steam generation, or increased cost of the fluid used for injection. What is needed are methods to maximize the efficiency of gravity-assisted viscous hydrocarbon recovery from underground formations by recovering and recycling the heated fluid that is injected during the process.

BRIEF DESCRIPTION OF THE DISCLOSURE

The disclosure provided herein provides methods for producing viscous hydrocarbons from an underground formation. In certain embodiments, a group of three wellbores is drilled into an underground formation containing viscous hydrocarbons and extended in a substantially horizontal direction through the formation. The horizontal components of the first two wellbores are spaced a short vertical distance apart, with well one above well two. A third well is drilled adjacent to the first pair of wells, and extended through the formation such that it is substantially parallel to the second wellbore in both horizontal and vertical planes, and at substantially the same depth in the formation as the second wellbore. These three wells are collectively referred to as a "production unit".

Hydrocarbon recovery from this production unit commences utilizing established gravity-assisted hydrocarbon recovery methodology (SAGD) in conjunction with a novel in-situ mobile water drive mechanism. A heated fluid is initially injected under pressure into wells one and two to create an initial steam chamber, while the third well produces in-situ mobile water, thereby creating a negative pressure that assists the lateral migration of the mobile heated fluids to heat the formation. This third well eventually also recovers the injectant for liquid and heat recycling. Eventually, well two is converted from injection to production mode, and the heated fluids recovered from wells two and three are recovered, re-heated, and once again injected into the formation. In certain embodiments, the heat within the produced fluids is transferred via a heat-exchanger to other fluids that are subsequently injected into the formation. Once a breakthrough of heated fluid occurs at the offset well, heated fluids and hot bitumen are produced. Thus, both oil and heated fluids are produced continuously by gravity to the lower, producer well of the original well pair and by Darcy's flow to the offset well.

The disclosure provided herein describes a method for recovering viscous hydrocarbons from an underground formation that increases the efficiency of hydrocarbon recovery while decreasing the overall need for fluid for injection. In certain embodiments, the hydrocarbon recovery process described herein requires far less makeup water for steam generation than methods that do not produce the in-situ water and recover the injectant for recycling. This method provides a cost savings in areas where water resources are limited and/or expensive. Thus, the resources required for hydrocarbon recovery are minimized, as well as the resultant environmental impact.

The term "injectant" as used herein describes any of a variety of materials that can be injected into an underground formation to decrease the viscosity of the hydrocarbons contained within. The term "injection" as used herein is synonymous with the term "circulation" and describes any method for putting a gas or fluid into a wellbore for distribution within an underground formation.

The term "wellbore" as used herein is synonymous with the term "well", as both terms describe a hole drilled into the earth at any angle using conventional drilling equipment.

The term "viscous hydrocarbon" as used herein is synonymous with the terms "heavy oil", "bitumen", "tar" or "asphaltic substance".

The term "hydrocarbon-bearing formation" as used herein is synonymous with any underground formation containing hydrocarbons, including viscous oil.

For purposes of the current disclosure, the term "substantially" is defined as being as close of an approximation to the desired specifications as is possible utilizing available technology.

BRIEF DESCRIPTION OF THE DRAWINGS

Advantages of the present invention will become apparent to those skilled in the art with the benefit of the following description and upon reference to the accompanying drawings.

Figure 1A:
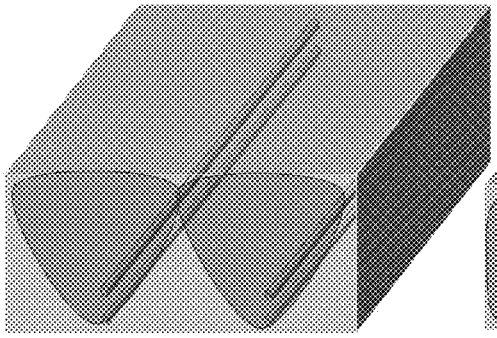
FIG. 1 is a calculated cross-section of the final drainage areas for a typical SAGD well pair [FIG. 1A] and for one embodiment of a "production unit" as disclosed herein [FIG. 1B]. These calculated drainage areas are related to the total percentage of viscous hydrocarbons within the formation that are actually recovered.

While the invention is susceptible to various modifications and alternative forms, specific embodiments thereof are shown by way of example in the drawings. The drawings may not be to scale. It should be understood that the drawings and their accompanying detailed descriptions are not intended to limit the scope of the invention to the particular forms or embodiments depicted, but rather, the intention is to cover all modifications, equivalents and alternatives falling within the spirit and scope of the present invention as defined by the appended claims.

DETAILED DESCRIPTION OF THE EMBODIMENTS

In some embodiments, the hydrocarbons that are recovered using the methods disclosed herein, may be fluids, such as heavy oils or bitumen, with initial API gravity less than 22°, less than 16°, or less than 10°.

For some embodiments, any displacement fluid forms the injectant, which may be a gas such as nitrogen, carbon dioxide, methane, or mixtures thereof. Such displacement fluids may also include steam, water, or an organic solvent for use in facilitating hydrocarbon recovery. In certain embodiments where the injectant comprises steam, the injector well couples to a steam source (or steam generator) that supplies the steam at a pressure in a range of about 100-1600 psi. Injectant is introduced into the injector well, then exits the injector well and enters the formation. The well completion may be open hole, or contain slotted or perforated liner wall sections that enable outflow of the steam along the injector portion of the well. The injectant passes into the reservoir to heat and mix with the viscous hydrocarbons in the reservoir, and eventually establishes fluid communication between the first and second wells. By producing in situ formation water from the adjacent third well, a reduced pressure is created that assists the migration of injectant from the first well pair in a lateral direction towards the third well. Eventually, fluid communication is established between the first well pair and the adjacent third well.

Figure 1B:
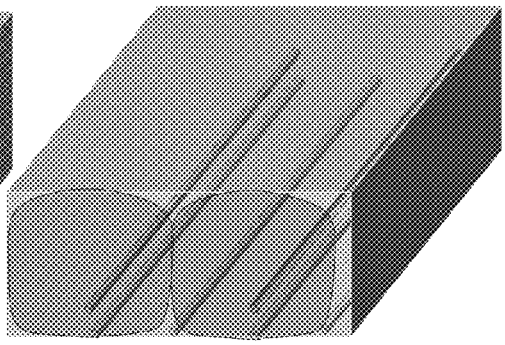

The injectant enhances recovery by creating pressure to drive the hydrocarbons and/or being miscible with the hydrocarbons to reduce viscosity of the hydrocarbons. When combined with the reduced pressure created by the adjacent third well, the high-pressure injectant may cause lateral migration of the hydrocarbons through the formation toward the third well, thereby expanding the gravity drainage area, and increasing the total percentage of hydrocarbons recovered from the formation, as well as the rate at which the hydrocarbons are produced [FIG. 1].

The distance between the offset well and the first two wells of the production unit is determined based on several variables known in the art, including the formation permeability and mobile water saturation, such that a pressure sink at the well can assist in drawing the heated fluids through the formation under a steady-state flow. The fluid transfers heat to the viscous hydrocarbons in the formation, thereby lowering the viscosity of the hydrocarbons and assisting their downward flow in response to gravity. In addition, the pressurized fluid provides an additional force to supplement the gravity-assisted migration of the hydrocarbons in a generally downward and/or lateral direction towards the two production wells.

The present invention provides an method for improving the efficiency of viscous hydrocarbon recovery from a subsurface formation. The basic unit of the current invention is a "production unit" consisting of three parallel, and substantially co-extensive horizontal wells. These wells are drilled downward through the overburden and into a formation containing viscous hydrocarbons. The direction of the drilling is then altered using established directional drilling technology until the direction of drilling is substantially horizontal. The wellbores are extended in a horizontal direction through the hydrocarbon-bearing formation, typically for a distance of between 30 and 3,000 meters.

The first and second wells of the "production unit" are spaced vertically, typically a few meters apart, and form a gravity-assisted drainage well pair, with well one located above well two. In certain embodiments, a pressurized heated fluid injectant (such as steam or an organic solvent) is initially injected into both wells one and two to heat the formation. Over a period of several weeks, as the viscosity of the hydrocarbons contained within the formation drops and the initial fluid communication for gravity drainage drive is established between the wells, the lower well is converted to production.

Figure 2:
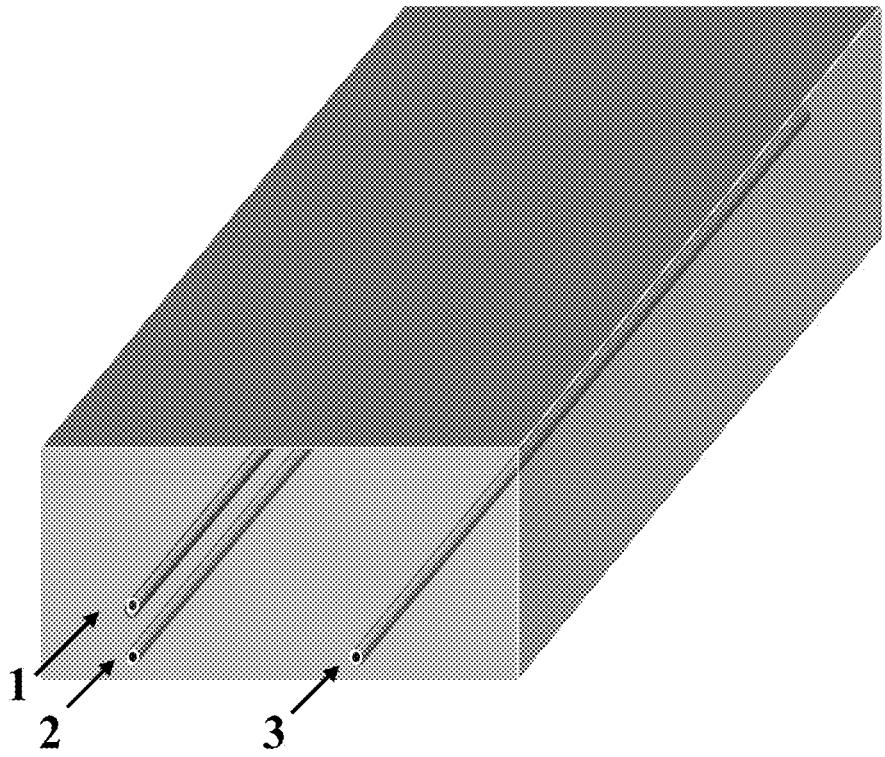
FIG. 2 is a cross-sectional schematic (not to scale) showing the general arrangement of the three wells in the well pattern of the current disclosure. Wells one and two are arranged with their horizontal portions in approximate vertical alignment, while the third well is laterally offset from the first well pair, and its horizontal portion extends through the formation at approximately the same depth as well two.

The third well of the "production unit" is drilled adjacent to the first pair of wells, and extended through the formation such that it is substantially parallel to the second wellbore in both horizontal and vertical planes, and at substantially the same depth in the formation as the second wellbore [FIG. 2]. In certain embodiments, the third well initially produces in-situ mobile water, thereby creating a reduced pressure (or "pressure sink") in the vicinity of the well. This reduced pressure stimulates migration of the injected heated fluids in a manner that expands the area of the formation heated by the injected fluid through convection heating. Once a breakthrough of heated fluid occurs at well three, heated fluids and hot oil (or bitumen) are produced. Thus, both liquid hydrocarbons and heated injectant are produced continuously by gravity to well two of the original well pair and laterally by Darcy's flow to well three.

In certain embodiments, the heated fluids recovered from production wells two and three are recovered, re-heated, and once again injected into the formation. In certain other embodiments, the heat within the produced fluids is transferred via a heat-exchanger to other fluids that are subsequently injected into the formation. Methods for transferring heat via a heat-exchanger are commonly known and can be implemented without undue experimentation.

In certain embodiments of the current invention, the injectant comprises a pressurized, heated liquid (such as steam, or a solvent) that is continuously injected into an underground formation containing viscous hydrocarbons. In certain embodiments, an injection steam flow directs steam at high pressure (1400 psig, for example) into one or more injection wells to reduce hydrocarbon viscosity within a formation containing viscous hydrocarbons. The injection steam flow may include steam alone or may be injected in combination with other injectants or solvents. The steam from the injection steam flow eventually condenses to create a heated oil/water mixture that has increased mobility in the formation. The oil/water mixture generally migrates downward (assisted by gravity) to well two, or may migrate laterally due to the "pressure sink" created by production at well three. The oil/water mix arrives at production wells two or three, and is brought to surface via production line. Separating the oil/water mixture within the production line provides an oil product and a water stream that can be re-heated and once again injected into the formation. In certain embodiments, where water is plentiful and is not recycled for reinjection, heat from the recovered liquid stream can be transferred via a heat exchanger to a fresh water stream to minimize the extra heat required to generate fresh steam for injection into the formation.

In certain embodiments where the injectant comprises steam, the quality of steam to be injected may be varied between 50% and 90%, while the injection pressure may be varied from 100-1600 psig. The pressure utilized for injection is preferably less than that required to fracture the formation, as fracture may lead to premature breakthrough of the heated liquid to wells two and three. The quality and quantity of steam to be injected is determined based upon both the relative porosity of the formation and the relative viscosity of the hydrocarbons contained within the formation. The variables of relative porosity and viscosity also affect the optimal spacing between the wellbores in the formation. In general, if the viscous hydrocarbon formation is of a high porosity, the wellbores are drilled further apart, and vice-versa.

Figure 3:
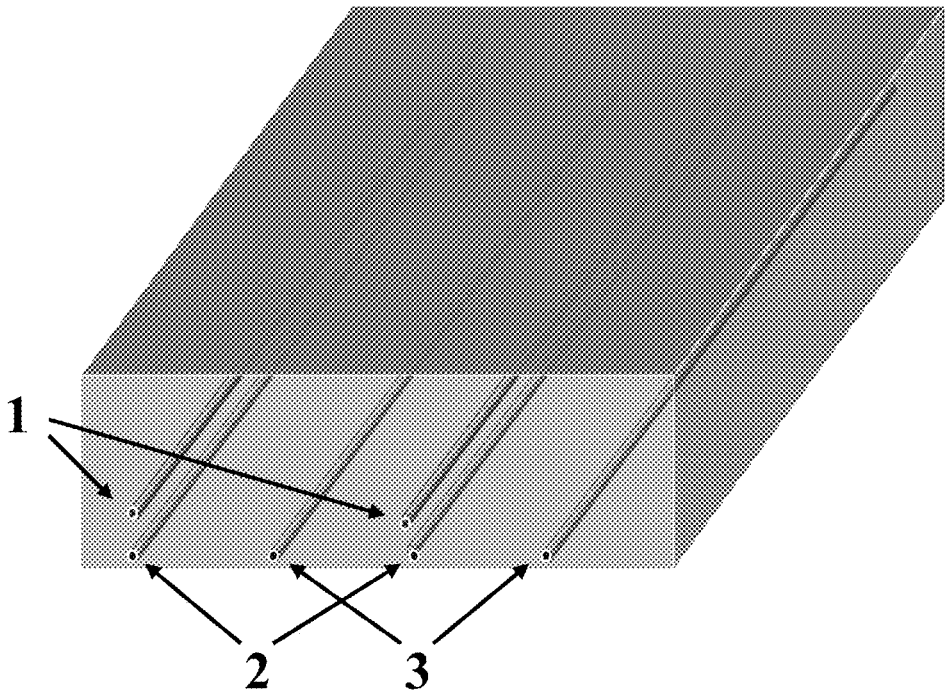
FIG. 3 is a cross-sectional schematic (not to scale) showing the general arrangement of multiple adjacent "production units", wherein the third, offset well of a first "production unit" may simultaneously produce viscous hydrocarbons mobilized by fluid injected into the first and second wells of a second "production unit".

In certain embodiments, a "production unit" consisting of three wells may be placed in close proximity with an adjacent production unit, such that the adjacent third well of a first production unit may simultaneously be in fluid communication with the first and second wells of an adjacent production unit. Additional production units may be placed laterally from a first production unit in this manner so as to cover an entire formation containing viscous hydrocarbons, thereby increasing the efficiency of hydrocarbon recovery [FIG. 3].

The methods provided herein allow the recovery of viscous hydrocarbons from an underground formation with increased efficiency, while decreasing the overall need for fluid for injection. In certain embodiments, the hydrocarbon recovery process described herein requires far less makeup water for steam injection than methods that do not recycle the injectant and recover the heat contained within it. The methods provided herein also provide a cost savings in geographic areas where water supplies are limited and/or expensive. The energy and resources required for hydrocarbon recovery are minimized, as well as the resultant environmental impact.

In summary, the embodiments disclosed herein describe a process for recovering viscous hydrocarbons from an underground hydrocarbon-bearing formation. This process may comprise one or more of the following steps: a) drilling a pair of separate and adjacent wellbores into an underground formation containing viscous hydrocarbons; b) extending the pair of wellbores though said formation in a substantially horizontal direction; the horizontal portion of first wellbore being substantially parallel to the second wellbore in both horizontal and vertical planes, and with the first wellbore placed in a substantially vertical plane above the second wellbore; c) heating the formation surrounding the first and second wellbores via the injection of a heated fluid into both wellbores until fluid communication is established between the first and second wellbores for gravity-assisted drainage; d) recovering a liquid comprising heated hydrocarbons from the formation, wherein said heated fluid is injected into the first, upper wellbore of the pair, and said liquid comprising heated hydrocarbons is produced via the lower, second wellbore; e) drilling a third wellbore into the same underground formation, and extending the wellbore through the formation such that it is substantially parallel to the second wellbore in both horizontal and vertical planes, laterally adjacent to the second wellbore, and at substantially the same depth in the formation as the second wellbore; e) establishing a negative pressure, or pressure sink, at the third wellbore and producing in situ mobile water from this wellbore until a fluid communication is established between the this wellbore and the first pair of wellbores; f) producing a liquid from the second and third wellbores comprising heated hydrocarbons and said heated fluid injected into the first wellbore, and recycling at least a portion of said produced liquid for re-injection into the formation via the first wellbore. In certain embodiments, the process further comprises multiple production units placed adjacent to each other at substantially the same depth in the hydrocarbon bearing formation, such that fluid communication may be established between well three of a first production unit, and wells one and two of a second production unit.

Certain embodiments may comprise a system for recovering viscous hydrocarbons from an underground hydrocarbon-bearing formation. This system may comprise one or more of the following steps: a) a pair of separate and adjacent wellbores drilled into an underground formation containing viscous hydrocarbons and extended though said formation in a substantially horizontal direction; the horizontal portion of first wellbore being substantially parallel to the second wellbore in both horizontal and vertical planes, and with the first wellbore spaced vertically from the second; b) a third wellbore that is drilled into the same underground formation, and extended the wellbore through the formation such that it is substantially parallel to the second wellbore in both horizontal and vertical planes, laterally adjacent to the second wellbore, and at substantially the same depth in the formation as the second wellbore; c) a heated fluid that is injected into the first and second wellbores and into the underground formation surrounding both wellbores until a fluid communication is established between wellbores one and two, then is injected into well one while wells two and three produce a liquid comprising heated hydrocarbons from the formation. In certain embodiments this system may additionally comprise one or more of the following steps: a) establishing a negative pressure, or pressure sink, at the third wellbore and producing in situ mobile water from this wellbore in order to establish a fluid communication between this wellbore and the first pair of wellbores, and b) producing a liquid comprising heated hydrocarbons from wells two and three; c) recycling a portion of the heated liquid produced from wellbores two and three for re-injection into the formation via the first wellbore; d) transferring at least a portion of the heat contained within the produced liquid to a fresh liquid for re-injection into the formation, wherein the heat contained within the produced liquid is transferred to a fresh liquid via a heat-exchanger, and said fresh liquid is then injected into the formation via wellbore one. In certain embodiments, the system may additionally comprise multiple production units that are placed adjacent to each other at substantially the same depth in the hydrocarbon bearing formation, such that fluid communication may be established between well three of a first production unit, and wells one and two of a second production unit.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. The forms of the invention shown and described herein are to be taken solely as examples of embodiments. Elements and materials may be substituted for those illustrated and described herein, parts and processes may be reversed and certain features of the invention may be utilized independently, all as would be apparent to one skilled in the art after having the benefit of this description of the invention. Changes may be made in the elements described herein without departing from the spirit and scope of the invention as described in the following claims.

I claim:

1. A process for recovering hydrocarbons from an underground hydrocarbon-bearing formation, comprising the following steps:

a. drilling a pair of separate and adjacent wellbores downward into the underground hydrocarbon-bearing formation containing viscous hydrocarbons, wherein the pair of separate and adjacent wellbores are referred to as a first wellbore and a second wellbore;

b. extending the pair of separate and adjacent wellbores through said formation in a substantially horizontal direction, wherein the horizontal portion of the first wellbore being substantially parallel to the horizontal portion of the second wellbore in both horizontal and vertical planes, wherein the first wellbore is spaced vertically from the second wellbore, wherein the first wellbore is located above the second wellbore;

heating the formation surrounding the first and second wellbores by injecting a heated fluid into both wellbores thereby creating an initial steam chamber;

c. drilling a third wellbore into the same formation, wherein the third wellbore is extended through the formation such that the third wellbore is substantially parallel to the second wellbore in both horizontal and vertical planes, laterally adjacent to the second wellbore, and at substantially the same depth in the formation as the second wellbore, wherein the third wellbore initially produces in-situ mobile water thereby creating reduced pressure in the vicinity of the wellbores, wherein the reduced pressure stimulates migration of heated fluid toward the third wellbore;

d. producing a liquid comprising hydrocarbons from the third wellbore and producing hydrocarbons and heated fluid from the first wellbore.

2. The process of claim 1, wherein a negative pressure, or pressure sink, is established at the third wellbore, and wherein in situ mobile water is produced until a fluid communication is established between the third wellbore and the first pair of wellbores.

3. The process of claim 1, wherein a liquid is produced from the third wellbore comprising hydrocarbons, in-situ water and the heated fluid that is injected into the formation via the first wellbore, and wherein at least a water portion of the produced heated fluid is re-injected into the formation through the first wellbore.

4. The process of claim 1, wherein liquid hydrocarbons are recovered from the third wellbore along with the heated fluid injected by the first wellbore, and at least a portion of the heat contained within the produced fluid is transferred to a fresh liquid for re-injection into the formation via the first wellbore.

5. The process of claim 1, wherein the heat contained within said produced heated fluid is transferred to a fresh injectant using a heat-exchanger to produce a heated fresh injectant, and the heated fresh injectant is injected into the formation via the first wellbore.

6. The process of claim 1, further comprising a production unit comprising a first, second and third wellbore, wherein multiple production units placed adjacent to each other at substantially the same depth in the hydrocarbon bearing formation, so that fluid communication may be established between well three of a first production unit, and wells one and two of a second production unit.

7. A process for recovering hydrocarbons from an underground hydrocarbon-bearing formation, comprising the following steps:

a. drilling a pair of separate and adjacent wellbores downward into the underground hydrocarbon-bearing formation containing viscous hydrocarbons, wherein the pair of separate and adjacent wellbores are each separately referred to as a first wellbore and a second wellbore;

b. extending the pair of separate and adjacent wellbores through said formation in a substantially horizontal direction, wherein a horizontal portion of first wellbore being substantially parallel to the second wellbore in both horizontal and vertical planes, wherein the first wellbore placed is in a substantially vertical plane above the second wellbore;

c. heating the formation surrounding the first and second wellbores via the injection of a heated fluid into both wellbores until fluid communication is established between the first and second wellbores for gravity-assisted drainage;

d. producing heated hydrocarbons and heated fluid from the formation, wherein said heated fluid is injected into an upper portion of the first and second wellbores, and the heated hydrocarbons and the heated fluid are produced via a lower portion of the second wellbore;

e. drilling a third wellbore into the same formation, and extending the wellbore through the formation such that it is substantially parallel to the second wellbore in both horizontal and vertical planes, laterally adjacent to the second wellbore, and at substantially the same depth in the formation as the second wellbore, wherein immediately prior to step (f), a negative pressure, or pressure sink, is established at the third wellbore and in situ mobile water is produced from this wellbore until a fluid communication is established between the this wellbore and the first and second wellbores;

f. producing a liquid from the third wellbores, wherein at least a portion of said produced liquid is recycled for re-injection into the formation via the first wellbore.

8. The process of claim 7, wherein the heat contained within the produced liquid in step (f) is transferred to fresh injectant using a heat-exchanger, and the heated fresh injectant is injected into the formation via wellbore one.

9. The process of claim 7, further comprising a production unit comprising a first, second and third wellbore, wherein multiple production units placed adjacent to each other at substantially the same depth in the hydrocarbon bearing formation, so that fluid communication may be established between well three of a first production unit, and wells one and two of a second production unit.

10. A system for recovering hydrocarbons from an underground hydrocarbon-bearing formation, comprising:

a. a pair of separate and adjacent wellbores drilled downward into an underground hydrocarbon-bearing formation containing viscous hydrocarbons and further extended though said formation in a substantially horizontal direction, wherein the par of separate and adjacent wellbores is referred to as a first wellbore and a second wellbore, wherein the horizontal portion of the first wellbore being substantially parallel to the second wellbore in both horizontal and vertical planes, wherein the first wellbore is spaced vertically from the second wellbore, and wherein the first wellbore is located above the second wellbore in the horizontal plane;

b. a third wellbore that is drilled downward into the same formation, wherein the third wellbore is extended through the formation such that it is substantially parallel to the second wellbore in both horizontal and vertical planes, laterally adjacent to the second wellbore, and at substantially the same depth in the formation as the second wellbore;

c. a heated fluid that is injected into the first wellbore and the second wellbore and into the underground formation surrounding both wellbores until a fluid communication is established between the first wellbore and the second wellbore;

d. an in-situ mobile water is initially produced from the third wellbore thereby creating reduced pressure in the vicinity of the wellbores, wherein the reduced pressure stimulates migration of heated fluid toward the third wellbore, then injecting the heated fluid into the first wellbore while the second wellbore produced hydrocarbons and heated fluid and third wellbores produce a liquid comprising heated hydrocarbons from the formation.

11. The system of claim 10, additionally comprising:

a. establishing a negative pressure, or pressure sink, at the third wellbore and producing in situ mobile water from this wellbore in order to establish a fluid communication between this wellbore and the first pair of wellbores, and b. producing a liquid comprising heated hydrocarbons from wells two and three.

12. The system of claim 11, additionally comprising: recycling a portion of the heated liquid produced from wellbores two and three for re-injection into the formation via the first wellbore.

13. The system of claim 11, additionally comprising: transferring at least a portion of the heat contained within the produced liquid to a fresh liquid for re-injection into the formation.

14. The system of claim 13, wherein at least a portion of the heat contained within the produced liquid is transferred to a fresh liquid via a heat-exchanger, and said fresh liquid is then injected into the formation via wellbore one.

15. The system of claim 10, further comprising multiple production units placed adjacent to each other at substantially the same depth in the hydrocarbon bearing formation, so that fluid communication may be established between well three of a first production unit, and wells one and two of a second production unit.

16. The system of claim 11, further comprising multiple production units placed adjacent to each other at substantially the same depth in the hydrocarbon bearing formation, so that fluid communication may be established between well three of a first production unit, and wells one and two of a second production unit.

17. The system of claim 12, further comprising multiple production units placed adjacent to each other at substantially the same depth in the hydrocarbon bearing formation, so that fluid communication may be established between well three of a first production unit, and wells one and two of a second production unit.

* * * * *